US006559591B2

(12) United States Patent
Murtishaw

(10) Patent No.: US 6,559,591 B2
(45) Date of Patent: May 6, 2003

(54) REMOVABLE GROUNDING STRIP FOR ANTI-REFLECTIVE FILMS ON CATHODE RAY TUBES AND METHOD OF USING SAME

(75) Inventor: David Allen Murtishaw, Sun City, CA (US)

(73) Assignees: Sony Corporation, Tokyo (JP); Sony Electronics, Inc., Park Ridge, NJ (US)

( * ) Notice: Subject to any disclaimer, the term of this patent is extended or adjusted under 35 U.S.C. 154(b) by 162 days.

(21) Appl. No.: 09/874,573

(22) Filed: Jun. 5, 2001

(65) Prior Publication Data

US 2002/0180337 A1 Dec. 5, 2002

(51) Int. Cl.[7] ..... H01J 31/00

(52) U.S. Cl. ..... 313/479; 313/477 R; 324/403; 324/404; 445/63; 445/3; 445/23; 445/45

(58) Field of Search ..... 324/403, 404, 324/405, 407, 103; 313/477 R, 479, 478, 461; 174/35 GC, 35 MS

(56) References Cited

U.S. PATENT DOCUMENTS 4,302,725 A * 11/1981 Nubani ..... 324/404
5,099,171 A * 3/1992 Daiku et al. ..... 313/479
5,703,431 A * 12/1997 Itou et al. ..... 313/461
5,742,119 A * 4/1998 Aben et al. ..... 313/479
5,879,217 A * 3/1999 Saito et al. ..... 445/23

FOREIGN PATENT DOCUMENTS

GB 2317740 A * 4/1998 ..... H01J/29/87

* cited by examiner

*Primary Examiner*—Michael H. Day
*Assistant Examiner*—Holly Harper
(74) *Attorney, Agent, or Firm*—Steven L. Nichols; Rader, Fishman & Grauer PLLC

(57) ABSTRACT

A non-adhesive, conductive strip is used to provide an electrical ground path between a solder electrode on the anti-reflective film of a cathode ray tube and the reinforcement or heat shrinkage band on the tube. The conductive strip is preferably held in place on the cathode ray tube using a magnet or magnets. Consequently, because the conductive strip is held in place by magnets and is non-adhesive, it can be removed and replaced repeatedly during the testing of the solder electrodes and anti-reflective film without potentially damaging the solder electrode or degrading the performance of the conductive tape that is typically used as the ground path in a completed cathode ray tube.

19 Claims, 4 Drawing Sheets

REMOVABLE GROUNDING STRIP FOR ANTI-REFLECTIVE FILMS ON CATHODE RAY TUBES AND METHOD OF USING SAME

FIELD OF THE INVENTION

The present invention relates to the field of cathode ray tube manufacture, More specifically, the present invention relates to the fields of applying and testing an anti-reflective film over the viewing surface of a cathode ray tube during manufacture of the tube. The present invention provides an improved method and device for selectively grounding the solder electrodes of the anti-reflective film so that the film and electrodes can be properly tested during production.

BACKGROUND OF THE INVENTION

Cathode ray tubes ("CRTs") are used in most television sets and computer and video monitors. A typical CRT is illustrated in FIG. 1. The CRT (100) is a glass tube with a bottle-like shape in which a relatively flat bottom portion (101) narrows into an elongated neck portion (102). The relatively flat portion (101) of the CRT (100) is the viewing surface and becomes the screen on which the display of the television set or monitor is generated when the CRT is incorporated therein.

An electro-luminescent material, such as phosphorus, that emits light when struck by an electron beam, is coated over the interior of the screen portion (101) of the CRT (100). An electron gun is then installed in the neck (102) of the CRT (100). A stream of electrons emitted from the electron gun is scanned over the electro-luminescent layer and turned on and off during the scanning to cause the electro-luminescent layer to glow in certain places and not others. In very simple terms, this is how an image is generated on the screen of a television or video monitor.

A yoke (not shown) is provided around the neck (102) of the CRT (100). This yoke produces a changing magnetic field through which the electron beam from the electron gun passes. The electron beam is deflected by the magnetic field of the yoke. Consequently, by varying the magnetic field created by the yoke in a precise cycle, the electron beam can be scanned, line-by-line, over the entire surface of the screen to generate video images thereon.

A cathode ray tube is generally constructed in the following matter. The neck (102) or funnel portion of the CRT (100) is formed open at both ends. Then the relatively flat bottom, or display portion (101) is sealed to the large end of the funnel and the electron gun is installed in the narrow end or neck of the funnel.

The display portion (101) is sealed to the funnel (102) using frit. Frit is a glass paste that can be cured or hardened. Frit, in paste form, is applied around the large end of the funnel (102) between the funnel (102) and the display portion (101). The frit is then cured or hardened to form a frit seal between the funnel (102) and the display portion (101).

After the frit is sealed, the tube (100) is evacuated and a strong vacuum is maintained inside the tube (100) throughout its life. Because of the strong vacuum inside the tube (100), there is a minimal risk that the tube (100) could implode. This risk is, of course, heightened if the tube (100) is damaged or mishandled. In the event of an implosion, a major concern would be flying glass shrapnel produced by the implosion.

To minimize the risk of both an implosion and a resulting spray of shrapnel, a metal band (103) is wrapped around the cathode ray tube (100) over the frit seal. This band (103) is called a reinforcement or heat-shrinkage ("HS") band.

An anti-reflective film (104) is also applied over the viewing surface of the screen portion (101). This anti-reflective film (104) minimizes the reflection of external light from the screen (101) of the cathode ray tube (100). Such reflection degrades the quality of the image that can be displayed on the screen (101) of the tube (100).

The anti-reflective film (104) is in electrical contact with solder electrodes (105) that are formed on the film (104). During the operation of the cathode ray tube (100) as a television or video monitor, the anti-reflective film (104) is electrically grounded through the solder electrodes (105). This grounding prevents a build-up of an electric charge on the anti-reflective film (104). Such an accumulated charge can damage the anti-reflective film (104).

The solder electrodes (105) are electrically connected to the HS band (103) by a piece of conductive tape (106), as shown in FIG. 1. This conductive tape (106) provides an electrical path from the solder electrode (105) into the HS band (103) for purposes of grounding the anti-reflective film (104) of the surface of the screen (101).

During manufacturing and testing of the cathode ray tube (100), it is necessary to test the anti-reflective film (104) and the resistance of the solder electrodes (105) provided on the film (104). In order to complete this testing, particularly the resistance of the solder electrodes (105), the conductive tape (106) must be removed so that the testing equipment can be used to test the resistance of the solder electrodes (105). The tape (106) is then replaced so that the anti-reflective film (104) can be tested. During testing of the anti-reflective film (104), it is necessary that the tape (106) be in place to prevent accumulated charge from damaging the anti-reflective film (104).

This entire process is repeated several times over a period of several days to ensure the quality of the solder electrodes (105) and the anti-reflective film (104). Unfortunately, the repeated removal and replacement of the conductive tape (106) can cause damage to the solder electrodes (105). Moreover, the more often the tape (106) is removed and replaced, the less well it adheres to the solder electrode (105). Consequently, during or after the testing, the tape (106) may no longer make a sufficient contact with the solder electrode (105) to effectively ground the anti-reflective film (104) thereby protecting the film (104) from damage due to accumulated electrical charge.

Consequently, there is a need in the art for an improved method and device for grounding the anti-reflective film and solder electrodes of a cathode ray tube during testing of the film and electrodes. Moreover, this improved means for grounding the anti-reflective film should be adapted for ready and easy removal and replacement as needed without the possibility of damaging or degrading the solder electrodes and other tube components.

SUMMARY OF THE INVENTION

The present invention meets the above-described needs and others. Specifically, the present invention provides an improved method and device for grounding the anti-reflective film and solder electrodes of a cathode ray tube during testing of the film and electrodes. Moreover, this improved means of grounding the anti-reflective film is adapted for ready and easy removal and replacement as needed without the possibility of damaging or degrading the solder electrodes and other tube components.

Additional advantages and novel features of the invention will be set forth in the description which follows or may be learned by those skilled in the art through reading these materials or practicing the invention. The advantages of the invention may be achieved through the means recited in the attached claims.

The present invention may be embodied and described as a device for selectively creating an electrical grounding path between an electrode of an anti-reflective film and a reinforcement band on a cathode ray tube. The device preferably includes a conductive strip that is sized and shaped to make electrical contact with an electrode of the anti-reflective film and the reinforcement band on a cathode ray tube so as to create an electrical grounding path between the electrode and the reinforcement band on the cathode ray tube; and a magnet for holding the conductive strip in place against the reinforcement band. The magnet is attracted to the metallic reinforcement band so as to hold the conductive strip in place.

In one preferred embodiment, the conductive strip and magnet are separate pieces. In an alternative preferred embodiment, the conductive strip and the magnet are integrated as a single unit.

The conductive strip may be formed of a flexible or rigid conductive material. Two preferred materials are silver and tungsten.

The present invention also encompasses the methods of making and using the device described above. Specifically, the present invention includes a method of testing electrodes of an anti-reflective film on a cathode ray tube and other components of the cathode ray tube by (1) creating a grounding electrical connection between an electrode of the anti-reflective film and a reinforcement band of the cathode ray tube with a conductive strip in electrical contact with both the electrode and the reinforcement band; and (2) holding the conductive strip in place with a magnet.

The method continues by selectively removing the conductive strip from the cathode ray tube by withdrawing the magnet. Following removal of the conductive strip, the method continues with testing the resistance of the electrode. Then, the method includes replacing the conductive strip in electrical contact with both the electrode and the reinforcement band; and holding the conductive strip in place with the magnet. At this point, the method can further include electrically testing other components of the cathode ray tube.

The benefit of this method of the present invention is that the conductive strip can be removed and replaced any number of times without potentially damaging the electrode on the anti-reflective film. Thus, the method of the present invention can further include again removing the conductive strip from the cathode ray tube by withdrawing the magnet; again testing a resistance of the electrode following removal of the conductive strip; again replacing the conductive strip in electrical contact with both the electrode and the reinforcement band; and holding the conductive strip in place with the magnet.

In forming the device of the present invention, the method may include integrally forming the conductive strip and the magnet as a single unit. As mentioned above, the conductive strip can be rigid or flexible and formed from any conductive material, preferably silver or tungsten.

BRIEF DESCRIPTION OF THE DRAWINGS

The accompanying drawings illustrate preferred embodiments of the present invention and are a part of the specification. Together with the following description, the drawings demonstrate and explain the principles of the present invention.

Throughout the drawings, identical elements are designated by identical reference numbers.

DETAILED DESCRIPTION OF THE PREFERRED EMBODIMENTS

Stated in broad principle, the present invention provides a non-adhesive, conductive strip that provides an electrical ground path between a solder electrode on the anti-reflective film of a cathode ray tube and the reinforcement or heat shrinkage band on the tube. The conductive strip is preferably held in place on the cathode ray tube using a magnet or magnets, as will be explained below. Consequently, because the conductive strip is held in place by magnets and is non-adhesive, it can be removed and replaced repeatedly during the testing of the solder electrodes and anti-reflective film without potentially damaging the solder electrode or degrading the performance of the conductive tape that is used as the ground path in a completed cathode ray tube.

Figure 1:
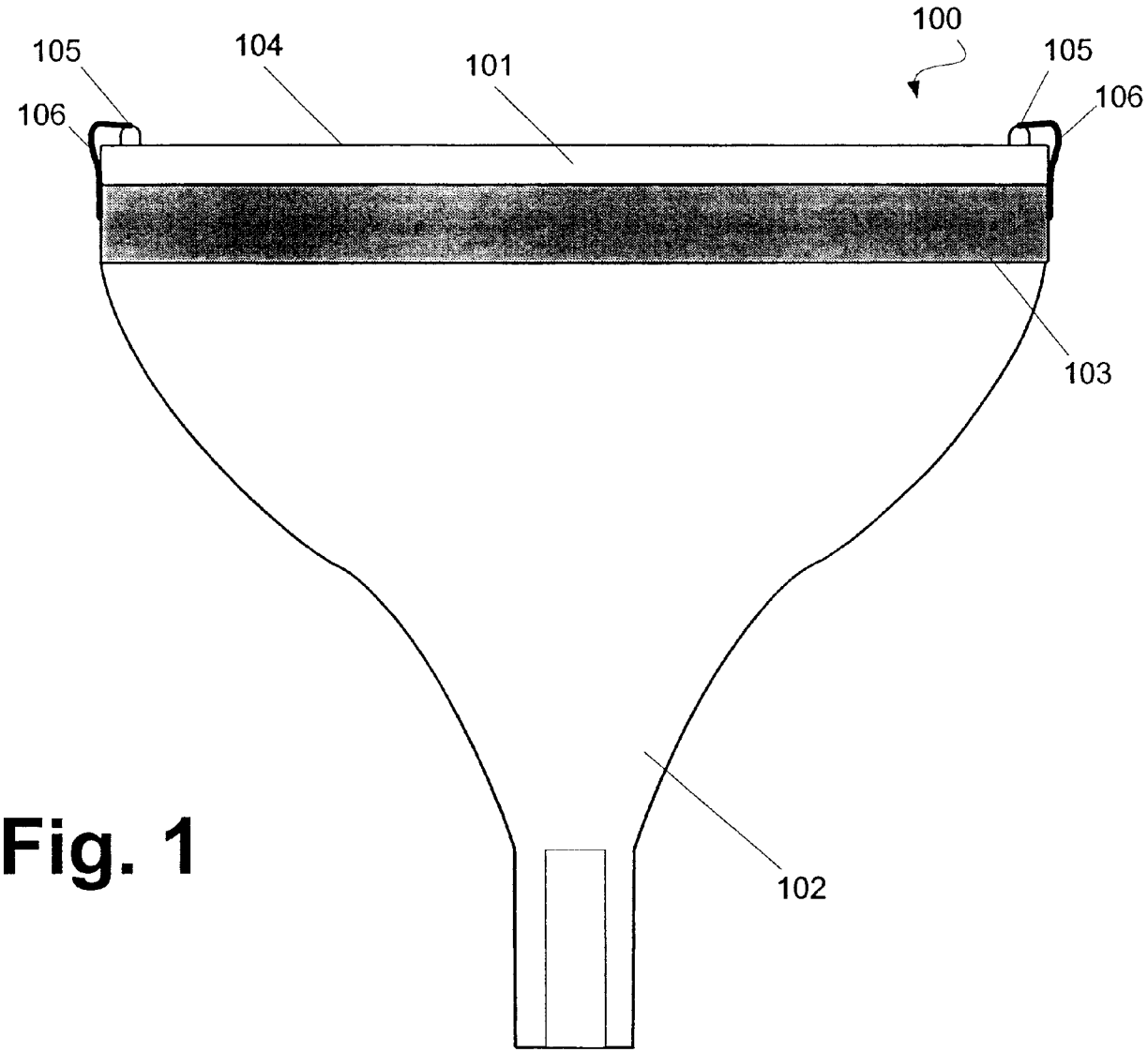
FIG. 1 is an illustration of a completed cathode ray tube after the components of the tube have been tested using the method and device of the present invention.

Using the drawings, the preferred embodiments of the present invention will now be explained. FIG. 1 is an illustration of a completed cathode ray tube after the components of the tube have been tested using the method and device of the present invention. After the conductive strip, which will be described in more detail below, is used to test the solder electrodes (105) and the anti-reflective film (104), conductive tape (106) can then be applied to provide the permanent grounding path between the solder electrodes (105) and the HS band (103). Because the conductive tape (106) is only applied once and not removed or replaced for testing or any other purposes, the tape (106) is better able to adhere to the solder electrode (105) and HS band (103). This allows the tape (106) to provide a more reliable grounding path to remove accumulated charge from the anti-reflective film (104). As noted above, if such accumulated charge is not released to ground, the film (104) can be damaged.

Figure 2:
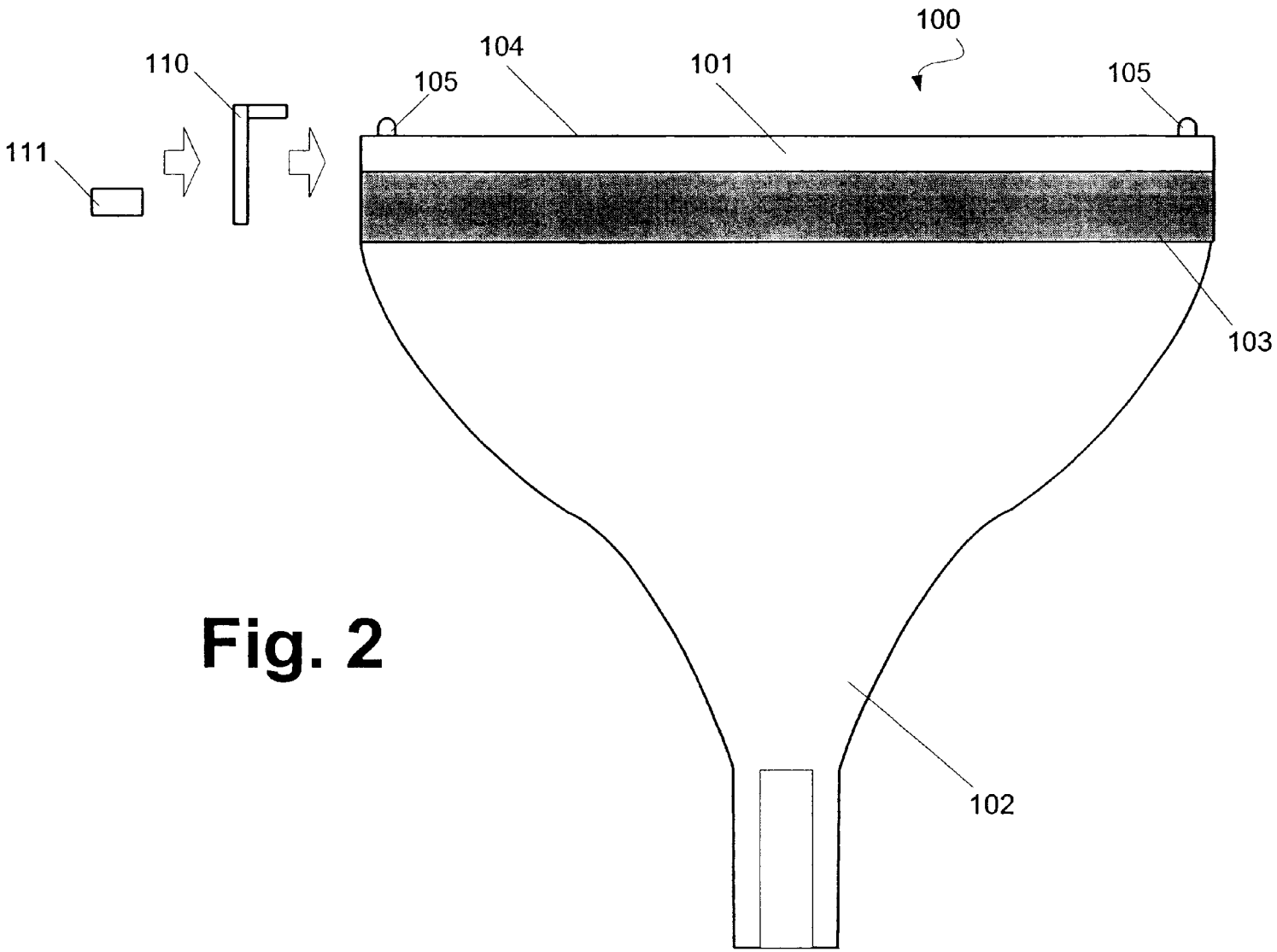
FIG. 2 is an illustration of an exploded view of a first embodiment of the present invention providing an improved means for grounding the anti-reflective film and solder electrodes of a cathode ray tube during testing of the film and electrodes.

FIG. 2 is an illustration of an exploded view of a first embodiment of the present invention which provides the improved means for selectively and repeatedly grounding the anti-reflective film and solder electrodes of a cathode ray tube during testing of the film and electrodes. As shown in FIG. 2, the first embodiment of the present invention is a conductive strip (110). This strip (110) may be made of any conductive material. Preferred materials include silver or tungsten.

The strip (110) can be flexible or malleable, or may be rigidly formed in the L-shape illustrated in FIG. 2. The conductive strip (110) is applied to the cathode ray tube (100) so as to be in physical and electrical contact with a solder electrode (105) and the HS band (103). Consequently, the conductive strip (110) provides an electrical path between the solder electrode (105) and the HS band (103) for the purpose of grounding the anti-reflective film (104) which is in electrical contact with the solder electrode (105).

The strip (110) is preferably held in place with a magnet or magnets. In the embodiment of FIG. 2, a single magnet (111) is illustrated. The magnetic field of this magnet (111) will attract the magnet to the metallic HS band (103). This magnetic attractive force is used to hold the magnet and the conductive strip (110) in place on the tube (100). Additionally, if the conductive strip (110) is made of a magnetizable material, the magnetic field of the magnet (111) will magnetize the conductive strip (110) which will, in turn, attract the HS band (103) to further hold the conductive strip (110) in place.

Figure 3:
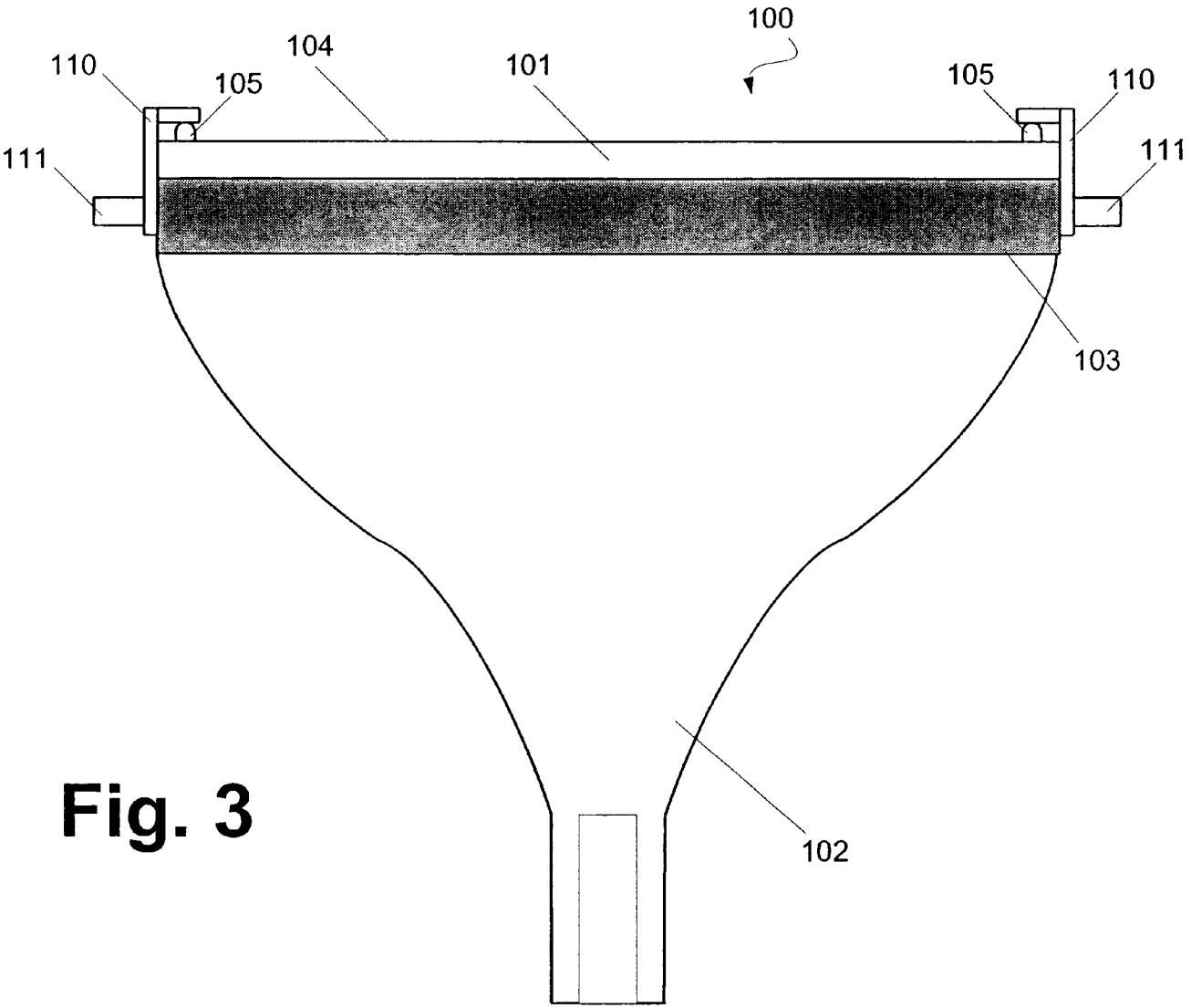
FIG. 3 is an illustration of an assembled view of the first embodiment of the present invention.

FIG. 3 is an illustration of an assembled view of the first embodiment of the present invention. As shown in FIG. 3 multiple conductive strips (110) can be provided and applied to the CRT (100) to create grounding paths between the solder electrodes (105) and the HS band (103).

Each conductive strip (110) is applied to the cathode ray tube (100) in physical and electrical contact with a solder electrode (105) and the HS band (103). Consequently, the conductive strip (110) provides an electrical path between the solder electrode (105) and the HS band (103) for the purpose of grounding the anti-reflective film (104) which is in electrical contact with the solder electrode (105).

Because the strip (110) is held in place with a magnet (111), the strip (110) can be removed and replaced as frequently as needed without potentially damaging the electrode (105). As shown in FIG. 3, the magnet (111) is attracted to the metallic HS band (103) thereby holding both itself and the conductive strip (110) in place on the tube (100). When the strip (110) is to be removed, the magnet (111) is simply pulled away from the strip (110) and band (103) to release the strip (110).

Consequently, the strip (110) can be removed and replaced repeatedly as needed so that the resistance of the solder electrodes (105) and the operation of the anti-reflective film can be alternatively tested. After the components of the tube have been tested, conductive tape (106) can then be applied, as illustrated in FIG. 1, to provide the permanent grounding path between the solder electrodes (105) and the HS band (103). Because the conductive tape (106) is only applied once and not removed or replaced for testing or any other purposes, the tape (106) is better able to adhere to the solder electrode (105) and HS band (103). This allows the tape (106) to provide a more reliable grounding path to remove accumulated charge from the anti-reflective film (104). As noted above, if such accumulated charge is not released to ground, the film (104) can be damaged.

Figure 4:
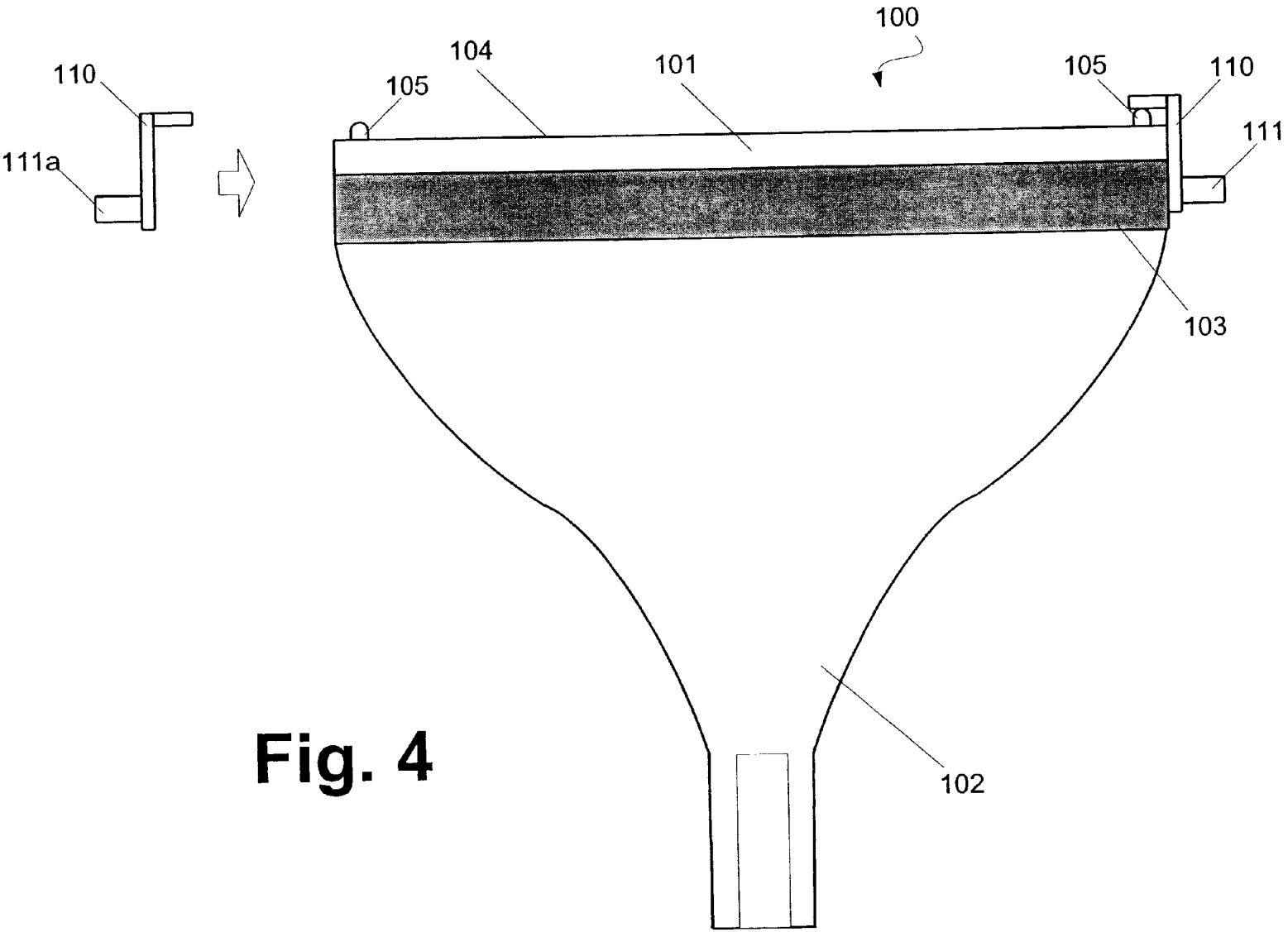
FIG. 4 is an illustration of a second embodiment of the present invention again providing an improved means for grounding the anti-reflective film and solder electrodes of a cathode ray tube during testing of the film and electrodes.

FIG. 4 is an illustration of a second embodiment of the present invention again providing an improved means for grounding the anti-reflective film and solder electrodes of a cathode ray tube during testing of the film and electrodes. In FIG. 4, the conductive strip (110) is formed integrally with a magnet or magnets (111*a*). In this way, the magnet (111*a*) has no chance of getting separated from the conductive strip (110) and will, therefore, always be available with the conductive strip (110) to hold the strip (110) in place on the tube (100).

The conductive strip (110) and magnet (111*a*) may be made from a single material or the magnet or magnets (111*a*) may be adhered to or otherwise integrated with the conductive strip. In any event, the unit (110, 111*a*) is removed from the tube (100) by simply pulling it away from the HS band (103).

The preceding description has been presented only to illustrate and describe the invention. It is not intended to be exhaustive or to limit the invention to any precise form disclosed. Many modifications and variations are possible in light of the above teaching.

The preferred embodiment was chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. A device for selectively creating an electrical grounding path between an electrode of an anti-reflective film and a reinforcement band on a cathode ray tube, said device comprising:

a conductive strip sized and shaped to make electrical contact with an electrode of an anti-reflective film and a reinforcement band on a cathode ray tube so as to create an electrical grounding path between said electrode and said reinforcement band on a cathode ray tube; and a magnet for holding said conductive strip in place against said reinforcement band.

2. The device of claim 1, wherein said conductive strip is formed of a flexible conductive material.

3. The device of claim 1, wherein said conductive strip is formed of a rigid conductive material.

4. The device of claim 1, wherein said conductive strip is formed of silver.

5. The device of claim 1, wherein said conductive strip is formed of tungsten.

6. The device of claim 1, wherein said conductive strip an d said magnet are integrated as a single unit.

7. A method of testing electrodes of an anti-reflective film on a cathode ray tube and other components of said cathode ray tube, said method comprising:

creating a grounding electrical connection between an electrode of said anti-reflective film and a reinforcement band of said cathode ray tube with a conductive strip in electrical contact with both said electrode and said reinforcement band; and holding said conductive strip in place with a magnet.

8. The method of claim 7, further comprising removing said conductive strip from said cathode ray tube by withdrawing said magnet.

9. The method of claim 8, further comprising testing a resistance of said electrode following removal of said conductive strip.

10. The method of claim 9, further comprising:

replacing said conductive strip in electrical contact with both said electrode and said reinforcement band; and holding said conductive strip in place with said magnet.

11. The method of claim 10, further comprising electrically testing components of said cathode ray tube.

12. The method of claim 11, comprising:

again removing said conductive strip from said cathode ray tube by withdrawing said magnet;

again testing a resistance of said electrode following removal of said conductive strip;

again replacing said conductive strip in electrical contact with both said electrode and said reinforcement band; and holding said conductive strip in place with said magnet.

13. The method of claim 7, further comprising integrally forming said conductive strip and said magnet as single unit.

14. The method of claim 7, further comprising forming said conductive strip from silver.

15. The method of claim 7, further comprising forming said conductive strip from tungsten.

16. A device used in a procedure for testing electrodes of an anti-reflective film on a cathode ray tube and other components of said cathode ray tube, said device comprising:

means for creating a grounding electrical connection between an electrode of said anti-reflective film and a reinforcement band of said cathode ray tube; and means for holding said grounding connection in place without using an adhesive.

17. The device of claim 16, wherein said means for creating a grounding electrical connection comprise a conductive strip in electrical contact with both said electrode and said reinforcement band.

18. The device of claim 16, wherein said means for holding said grounding connection in place comprise a magnet.

19. The device of claim 16, wherein said means for creating a grounding electrical connection and said means for holding said grounding connection in place are integrated into a single unit.

* * * * *

UNITED STATES PATENT AND TRADEMARK OFFICE

CERTIFICATE OF CORRECTION

PATENT NO. : 6,559,591 B2
DATED : May 6, 2003
INVENTOR(S) : David Allen Murtishaw It is certified that error appears in the above-identified patent and that said Letters Patent is hereby corrected as shown below:

Column 6,
Lines 33-34, change “an d” to -- and --

Signed and Sealed this

Fifteenth Day of July, 2003

JAMES E. ROGAN
*Director of the United States Patent and Trademark Office*